United States Patent [19]

Sevilla

[11] Patent Number: 5,076,029

[45] Date of Patent: Dec. 31, 1991

[54] HELIUM-FILLED SUN SHADES

[76] Inventor: Frederick J. Sevilla, 920 S. Coleman, Mesa, Ariz. 85210

[21] Appl. No.: 460,243

[22] Filed: Jan. 2, 1990

[51] Int. Cl.[5] ..... E04B 1/34

[52] U.S. Cl. ..... 52/2.24; 244/33; 52/2.25

[58] Field of Search ..... 52/2 J, 2 K; 244/31, 244/33, 146

[56] References Cited

U.S. PATENT DOCUMENTS

| | | | |
|---|---|---|---|
| 2,411,316 | 11/1946 | Capita | 52/2 J |
| 2,863,467 | 12/1958 | Hearell | 135/99 X |
| 3,030,640 | 4/1962 | Grosman | 52/2 J X |
| 3,052,054 | 9/1962 | Littleton et al. | 52/2 J X |
| 3,184,742 | 5/1965 | Cutler | 343/18 |
| 3,412,963 | 11/1968 | Struble, Jr. | 244/31 X |
| 4,013,018 | 3/1977 | Hanson et al. | 52/2 J X |
| 4,160,523 | 7/1979 | Stevens | 52/2 J X |
| 4,257,199 | 3/1981 | Kuboyama | 52/2 J X |
| 4,629,433 | 12/1986 | Magid | 52/2 J X |
| 4,643,210 | 2/1987 | Feld | 135/20 B |
| 4,705,238 | 11/1987 | Gargano | 244/146 X |
| 4,750,508 | 6/1988 | Tatoian | 135/118 X |
| 4,768,739 | 9/1988 | Schnee | 244/31 X |
| 4,771,970 | 9/1988 | Sutton | 244/146 X |
| 4,811,920 | 3/1989 | Askwith et al. | 244/146 X |

FOREIGN PATENT DOCUMENTS

| | | | |
|---|---|---|---|
| 425038 | 5/1911 | France | 244/146 |
| 440584 | 12/1967 | Switzerland | 52/2 J |

*Primary Examiner*—Richard E. Chilcot, Jr.
*Assistant Examiner*—Lan Mai
*Attorney, Agent, or Firm*—Don J. Flickinger; Jordan M. Meschkow

[57] ABSTRACT

A sun shade is formed from two sheets of a tough, yet flexible material which have been cut to an appropriate shape and size, and sealed together at the edges to form a flat, balloon-like structure. A plurality of interconnecting flow channels or buoyant cells are stitched into the sheets to enable the structure to retain its shape without bulging. A conventional fill valve is provided for filling the space between the sheets with helium or another suitable gas. The shade is anchored above a selected surface using cables or other flexible connectors.

8 Claims, 1 Drawing Sheet

HELIUM-FILLED SUN SHADES

BACKGROUND OF THE INVENTION

1. Field of the Invention

This invention relates to the art of sun shades.

More particularly, this invention relates to inflatable sun shades.

In a further and more specific aspect, the instant invention concerns helium-filled shades for providing overhead protection to individuals engaged in outdoor activities such as hiking, tubing and picnicking.

2. Description of the Prior Art

Most sportsmen and outdoors enthusiasts are well acquainted with the dangers of prolonged exposure to intense heat and sunlight. In order to avoid these dangers, which include sunburn, sunstroke, dehydration and skin cancer, most individuals take certain precautions such as applying sun block, wearing broad-brimmed hats or visors, carrying umbrellas or parasols, or simply remaining under canopied areas.

Each of the above precautions has its drawbacks, however. Sun blocks, for instance, are only effective for limited periods of time and must be constantly reapplied. Hats and visors only protect a very small area around the wearer's head, and are often quite uncomfortable. Umbrellas and parasols must be held by hand, and are therefore unusable during activities which require the use of both hands. Stationary canopies are satisfactory for activities which take place within a confined area, but not for those which are carried out over large distances.

It would be highly advantageous, therefore, to remedy the foregoing and other deficiencies inherent in the prior art.

Accordingly, it is an object of the present invention to provide an improved sunshade for protecting individuals during outdoor activities.

Another object of the invention is the provision of a sunshade which can easily be transported from place to place.

And another object of the invention is to provide a sunshade which can be carried by a single individual without requiring the use of the individual's hands.

Still another object of the invention is the provision of helium-filled sun shade.

Yet another object of the invention is to provide a helium filled sun shade with cables which can be tied to an individual or his clothing.

Yet still another object of the invention is the provision of a sun shade which can be tied to a water flotation device such as an inner tube.

And a further object of the invention is to provide a buoyant, stationary sun shade which can be secured to the ground to protect a relatively large surface area such as a group of picnic tables.

And still a further object of the invention is the provision of a canopy which is completely self-supporting and does not require the use of poles or other rigid supports.

And still a further object of the invention is the provision of a helium-filled sun shade, according to the foregoing, which is relatively inexpensive to manufacture and comparatively simple and easy to use.

SUMMARY OF THE INVENTION

Briefly, to achieve the desired objects of the instant invention in accordance with the preferred embodiment thereof, a helium-filled sun shade is provided for protecting individuals engaged in outdoor activities.

More specifically, the sun shade is formed from two sheets of a tough, yet flexible material which have been cut to an appropriate shape and size, and sealed together at the edges to form a flat, balloon-like structure. A plurality of interconnecting flow channels or buoyant cells are stitched into the sheets to enable the structure to retain its shape without bulging A conventional fill valve is provided for filling the space between the sheets with helium or another suitable gas.

Portions of the seam between the two sheets are extended to form flattened corners or tabs which extend outwardly of the shade. Each corner or tab is provided with an eyelet to which a cable or other flexible connector is attached. The opposite end of the connector is tied or otherwise secured to the surface which is being protected.

The sun shade may be used in a wide variety of applications. In one application, the ends of the connectors are tied around an inner tube of the type used for river rafting, thus shielding the occupants of the tube from excessive sunlight. In another application, the ends of the connectors may be looped around a hiker's shoulders. In another application, a larger version of the sun shade may be suspended over a group of picnic tables to form a stationary canopy for keeping picnickers cool.

The sun shade can also provide protection from light rain, as well as sunlight.

BRIEF DESCRIPTION OF THE DRAWINGS

The foregoing and further and more specific objects and advantages of the instant invention will become readily apparent to those skilled in the art from the following detailed description of preferred embodiments thereof taken in conjunction with the drawings in which.

DETAILED DESCRIPTION OF THE PREFERRED EMBODIMENT

Figure 1:
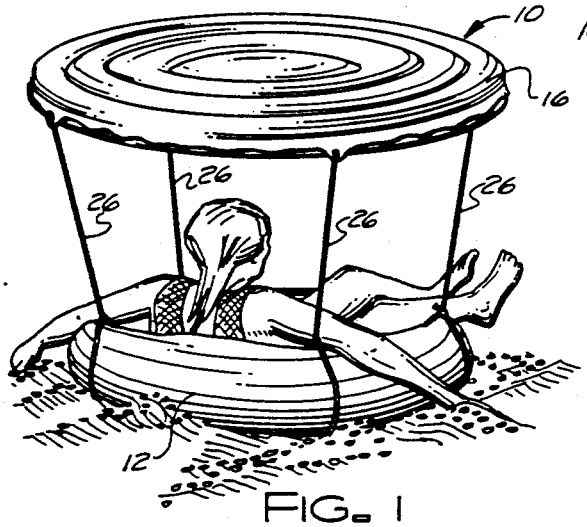
FIG. 1 is a perspective view showing an inner tube shielded by a sunshade according to the present invention.

Turning now to the drawings in which like reference characters indicate corresponding elements throughout the several views, attention is first directed to FIG. 1, which shows a sun shade 10 according to the instant invention secured to an inner tube 12 of the type used for river rafting.

Figure 4:
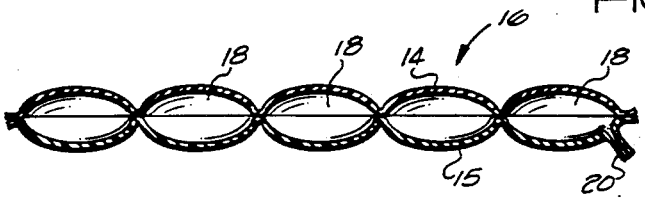
FIG. 4 is a sectional view taken through line 4—4 of FIG. 3.
Figure 3:
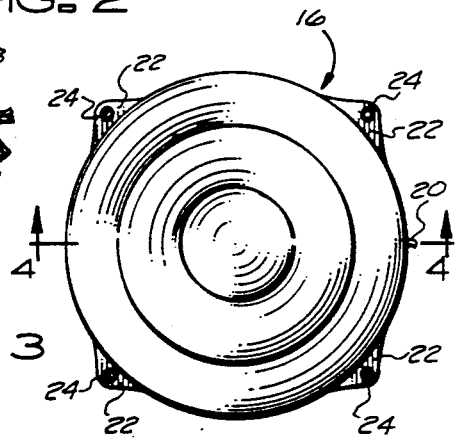
FIG. 3 is a plan view of the sun shade according to the present invention.

The sun shade 10, shown in greater detail in FIGS. 3 and 4, comprises two sheets 14, 15 of a tough, yet flexible material which have been sealed together at the edges to form a flat, balloon-like canopy 16. A preferred material is the polyester film identified by the trademark "MYLAR". The shape and size of the sheets may vary according to intended use as well as personal tastes, but in the illustrated embodiment, a circular shape of slightly larger diameter than the outer diameter of the inner tube is preferred.

To enable the shade 10 to maintain its shape and avoid bulging, the sheets 14, 15 are creased, crimped, stitched or sealed together at regular intervals to form a plurality of fluidly communicating flow passages or buoyant cells 18. In the illustrated embodiment, the passages or cells 18 extend circularly, but other configurations may also be used.

A conventional fill valve 20 is provided for filling the space between the sheets 14, 16 with helium or another suitable lighter-than-air gas. This enables the shade 10 to support its own weight, without the need for poles or rigid stays.

Portions of the seam at the intersection of the sheets 14, 16 are extended to form flattened corners or tabs 22 which extend outwardly of the shade 10. Each corner or tab 22 is provided with an eyelet 24 to which a cable, rope, cord or other flexible connector 26 is attached. The opposite end of each connector 26 is wrapped around the inner tube 12 and tied or otherwise secured to prevent the shade 10 from drifting away.

Figure 2:
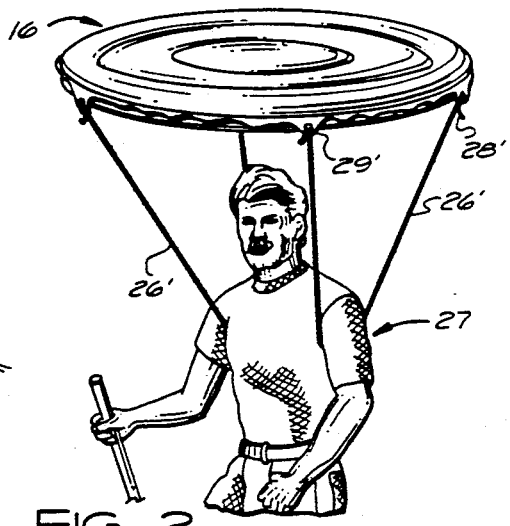
FIG. 2 is a perspective view showing an alternative embodiment of the sun shade used to protect a hiker from intense sunlight.

An alternative embodiment of the invention, for shielding a hiker, jogger or other individual 27, is illustrated in FIG. 2. Canopy 16 of this embodiment is identical in structure to canopy 16 in FIG. 1, differing only in that it is secured directly to the individual 26 rather than to his surroundings. Only two flexible connectors 26' are used, in contrast to the four connectors used in the embodiment of FIG. 1. Each connector 26' comprises a flexible cord, cable or rope having a first end 28' received in one of the eyelets 24 of the canopy and a second end 29' received in an adjacent eyelet. To carry the sun shade, the individual 26 simply slips one arm through the U-shaped loop or harness formed by the intermediate portion of one of the connectors 26, and the other arm through the loop or harness formed by the other connector 26. This maintains the sun shade in position above the individual's head, while keeping both of the individual's hands free for other activities.

Figure 5:
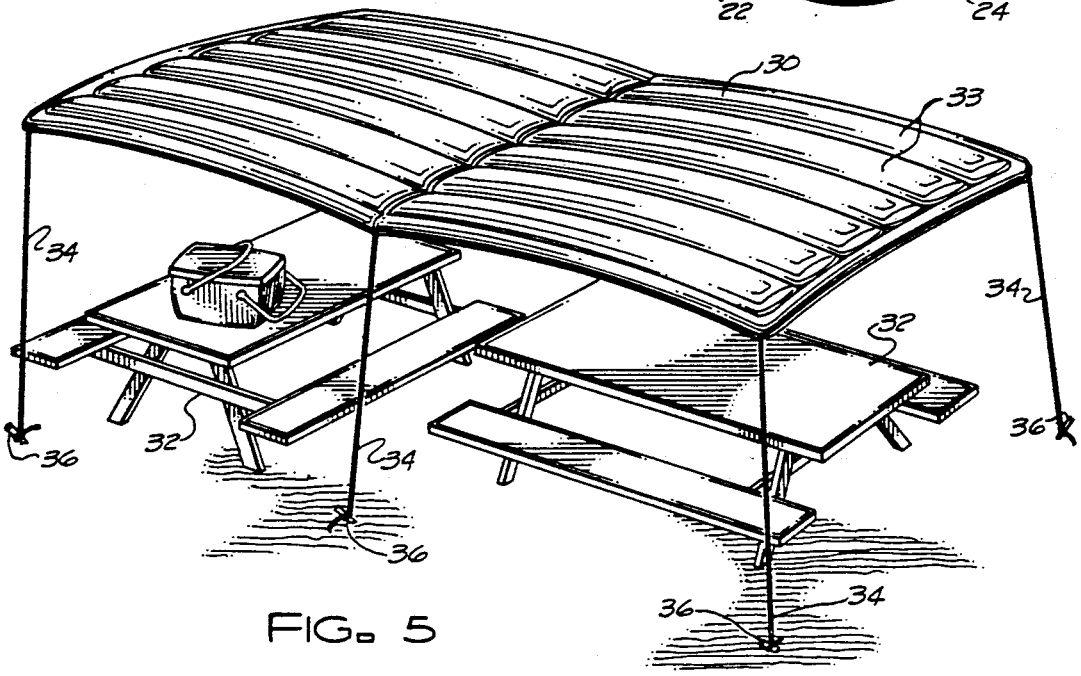
FIG. 5 is a perspective view showing an alternative embodiment of the invention used to protect a picnic area.

Still another embodiment of the invention is shown in FIG. 5. In this embodiment, the canopy 30 is rectangular rather than circular in configuration, and its dimensions have been increased to provide sufficient cover for a group of picnic tables 32. Once again, the canopy is formed from sheets of "MYLAR" which have been sealed together and divided into interconnecting cells or flow passages 33 filled with helium or the like. The seams of the canopy are provided with a plurality of regularly spaced eyelets (not shown) to which are attached flexible cables 34 or other connectors. The bottoms of the cables or connectors 34 are secured to stakes 36 which anchor the sun shade to the ground. Because the canopy extends horizontally and does not include any side walls, it provides excellent overhead cover while allowing unobstructed access to the picnic area from all sides.

Various modifications and variations to the embodiments herein chosen for purposes of illustration will readily occur to those skilled in the art. For instance, the shape and size of the sun shade may be varied to correspond to the shape and size of the area to be covered. To the extent that such variations and modifications do not depart from the spirit of the invention, they are intended to be included within the scope thereof which is assessed only by a fair interpretation of the following claims.

Having fully described and disclosed the instant invention and alternately preferred embodiments thereof in such clear and concise terms as to enable those skilled in the art to understand and practice the same, the invention claimed is:

1. A body-carried sun shade for protecting a person comprising:

a) an inflatable canopy including i) a first sheet of flexible material having a plurality of edges, said sheet having a predetermined width ii) a second sheet of flexible material having a plurality of edges secured to said edges of said first sheet and having a width approximately equal to the width of said first sheet, with a portion of said second sheet being spaced from said first sheet to define an enclosed hollow area, and iii) a fill valve communicating with said hollow area for filling said hollow area with helium; said valve controls the flow of helium into and out of said hollow area; and b) a plurality of flexible connectors secured to said canopy for suspending said canopy over the head of said person and attaching said canopy to the body of said person such that said canopy is movable with said person.

2. A sun shade according to claim 1, further comprising a seam formed along the edges of said first and second sheets, portions of said sheet being extended to form tabs, each of said tabs having an eyelet for receiving the end of a flexible connector.

3. A sun shade according to claim 2, wherein each of said connectors comprises a cable having a first end received in one of said eyelets and a second end received in an adjacent eyelet, the portion of said cable between said first and second ends forming a U-shaped harness for fitting under the person's underarm.

4. A sun shade according to claim 1, wherein said flexible material comprises a polyester film.

5. A sun shade according to claim 1, wherein said first and second sheets are crimped together at regular intervals to define a plurality of fluidly communicating cells.

6. A sun shade according to claim 5, wherein said plurality of fluidly communicating cells comprise a plurality of concentric annular cells.

7. A sun shade according to claim 6, wherein the outer diameter of the outermost of said concentric annular cells is slightly greater than the distance from the outer end of a person's shoulder to the outer end of the person's other shoulder.

8. A sun shade according to claim 1, wherein the width of each said sheets is slightly greater than the distance from the outer end of a person's shoulder to the outer end of the person's other shoulder.

* * * * *